US012747889B2

(12) United States Patent
Baig et al.

(10) Patent No.: US 12,747,889 B2
(45) Date of Patent: Sep. 29, 2026

(54) CONDENSATE DISCHARGE TRAYS

(71) Applicant: Lennox Industries Inc., Richardson, TX (US)

(72) Inventors: Mirza Yaseen Baig, Tamil Nadu (IN); Poly Joseph, Tamil Nadu (IN); Surendran Ramasamy, Tamil Nadu (IN)

(73) Assignee: Lennox Industries Inc., Richardson, TX (US)

( * ) Notice: Subject to any disclaimer, the term of this patent is extended or adjusted under 35 U.S.C. 154(b) by 176 days.

(21) Appl. No.: 18/385,361

(22) Filed: Oct. 30, 2023

(65) Prior Publication Data

US 2025/0137683 A1 May 1, 2025

(51) Int. Cl.
*F24F 13/22* (2006.01)

(52) U.S. Cl.
CPC ..... *F24F 13/222* (2013.01); *F24F 2013/225* (2013.01); *F24F 2013/227* (2013.01)

(58) Field of Classification Search
CPC ..... F24F 13/222; F24F 2013/225; F24F 2013/227; F24F 1/022; F24F 13/22; F24F 2003/144
See application file for complete search history.

(56) References Cited

U.S. PATENT DOCUMENTS 2,048,282 A * 7/1936 Neeson ..... F24F 13/22 62/331
6,167,716 B1 * 1/2001 Fredrick ..... F25B 39/02 62/283
2017/0167737 A1 * 6/2017 Kil ..... F24F 1/0323

FOREIGN PATENT DOCUMENTS

KR 20150089818 A * 8/2015 ..... F24F 1/022

* cited by examiner

*Primary Examiner* — Frantz F Jules
*Assistant Examiner* — Martha Tadesse
(74) *Attorney, Agent, or Firm* — Johnston IP Law, PLLC

(57) ABSTRACT

In a heating, ventilating, and cooling (HVAC) context, a condensate distribution tray is used to receive condensate produced by an evaporator coil and deliver the condensate in a distributed, controlled fashion to the condenser to evaporate the condensate. The condensate distribution tray may have a plurality of tanks for receiving condensate and a plurality of spillways for directing and controlling the rate of the condensate on the condenser. In some instances, a plurality of apertures in the spillways may be sized differently to control the rate of condensate delivery onto different portions of the condenser. Other systems and devices are presented.

14 Claims, 10 Drawing Sheets

CONDENSATE DISCHARGE TRAYS

TECHNICAL FIELD

This application is directed, in general, to heating, ventilating, and cooling (HVAC) systems, and more specifically, to condensate discharge trays.

BACKGROUND

The following discussion of the background is intended to facilitate an understanding of the present disclosure only. It should be appreciated that the discussion is not an acknowledgement or admission that any of the material referred to was part of the common general knowledge at the priority date of the application.

Heating, ventilating, and cooling (HVAC) systems can be used to regulate the environment within an enclosed space. Typically, an air blower is used to pull air (i.e., return air) from the enclosed space or pull air from an outside source into the HVAC system through ducts and push the air into the enclosed space through additional ducts after conditioning the air (e.g., heating, cooling or dehumidifying the air). Unless otherwise indicated, as used throughout this document, "or" does not require mutual exclusivity. Various types of HVAC systems may be used to provide conditioned air for enclosed spaces or other purposes.

These HVAC systems include a number of heat exchangers, notably one or more condensers. The HVAC systems may take a variety of sizes and styles including small residential units and large-scale roof-top units for commercial applications. In the typical HVAC system, the one or more condensers receive compressed, gaseous refrigerant from one or more compressors and condense the refrigerant into liquid form. The condenser discharges compressed, liquid refrigerant, which is then delivered to one or more evaporators, or evaporator coils, to cool air to be provided to the building or for other use. The liquid refrigerant is evaporated as it passes through the evaporator producing the gaseous refrigerant that is delivered to one or more compressors to produce a compressed gas refrigerant that is delivered to the one or more condensers. In some systems, condensate is produced that is collected in a drain pan and removed through a drain plug in the drain pan.

SUMMARY

According to an illustrative embodiment, a heating, ventilating, and cooling (HVAC) system includes a closed refrigeration circuit and a condensate distribution tray. The closed refrigeration circuit includes a plurality of conduits, a compressor fluidly coupled to the plurality of conduits for compressing a refrigerant, a condenser fluidly coupled to the plurality of conduits for receiving refrigerant from the compressor and cooling the refrigerant, an evaporator, and an expansion valve fluidly coupled to the plurality of conduits between the evaporator and condenser. The evaporator receives refrigerant from the expansion valve, and the evaporator is fluidly coupled to the compressor for delivering the refrigerant to the compressor. A condensate collection pan is proximate the evaporator for receiving condensate, which forms on the evaporator. The condensate discharge tray is coupled to a top portion of the condenser. The system also includes a condensation collection conduit that is fluidly coupled to the condensate collection pan and the condensate discharge tray.

The condensate discharge tray includes a longitudinal body formed with a plurality of longitudinal tanks for receiving condensate. The condensate discharge tray also includes a plurality of longitudinal spillways formed adjacent to the plurality of longitudinal tanks and aligned to deliver condensate in a dispersed fashion on the condenser.

According to another illustrative embodiment, a condensate discharge tray for coupling to a top portion of a condenser in an HVAC system includes a longitudinal body formed with at least a first longitudinal spillway, a first tank, a second longitudinal spillway, a second tank, and a third longitudinal spillway. In a lateral cross section and going from a portion aligned with an outward portion of a condenser when installed, the first longitudinal spillway is adjacent to an external wall, the first longitudinal spillway is adjacent on one side to the first tank, the first tank is also adjacent to the second longitudinal spillway, the second longitudinal spillway is adjacent to the second tank, the second tank is also adjacent to the third longitudinal spillway. The condensate discharge tray further includes a plurality of apertures formed in the first longitudinal spillway, second longitudinal spillway, and third longitudinal spillway for providing a flow path for condensate to exit the first longitudinal spillway, second longitudinal spillway, and third longitudinal spillway and be directed onto the condenser.

According to still another illustrative embodiment, a heating, ventilating, and cooling (HVAC) system includes a closed refrigeration circuit comprising a condenser and an evaporator and includes a condensate distribution tray. The system further includes an evaporator and a condensate collection pan proximate the evaporator for receiving condensate which forms on the evaporator. The condensate discharge tray is fluidly coupled to the condensate collection pan and coupled to a top portion of the condenser.

The condensate discharge tray includes at least one longitudinal tank for receiving condensate from the condenser and at least one longitudinal spillway fluidly coupled to the at least one longitudinal tank for receiving condensate therefrom. The condensate discharge tray is formed with a plurality of apertures in the at least one longitudinal spillway for allowing condensate to discharge from the condensate discharge tray onto the condenser. Other systems, devices, and methods are presented below.

DESCRIPTION OF THE DRAWINGS

Illustrative embodiments of the present invention are described in detail below with reference to the attached drawing figures, which are incorporated by reference herein and wherein.

DETAILED DESCRIPTION

In the following detailed description of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the claims. Unless otherwise indicated, as used throughout this document, "or" does not require mutual exclusivity.

According to an illustrative embodiment, condensate produced by a heating, ventilating, and cooling (HVAC) system is directed by a condensate discharge tray over the condenser in a manner to evaporate the condensate such that draining is not required or minimally required and the efficiency of the condenser may be improved.

Some HVAC systems are all-in-one heating and cooling systems. Such systems integrate components into a unit that may be used on an exterior wall. These are often used for condominiums and multifamily properties. In such units, the evaporator is above the condenser and a condensate discharge tray may be readily used. The condensate discharge tray may be used in other embodiments as well.

Figure 1:
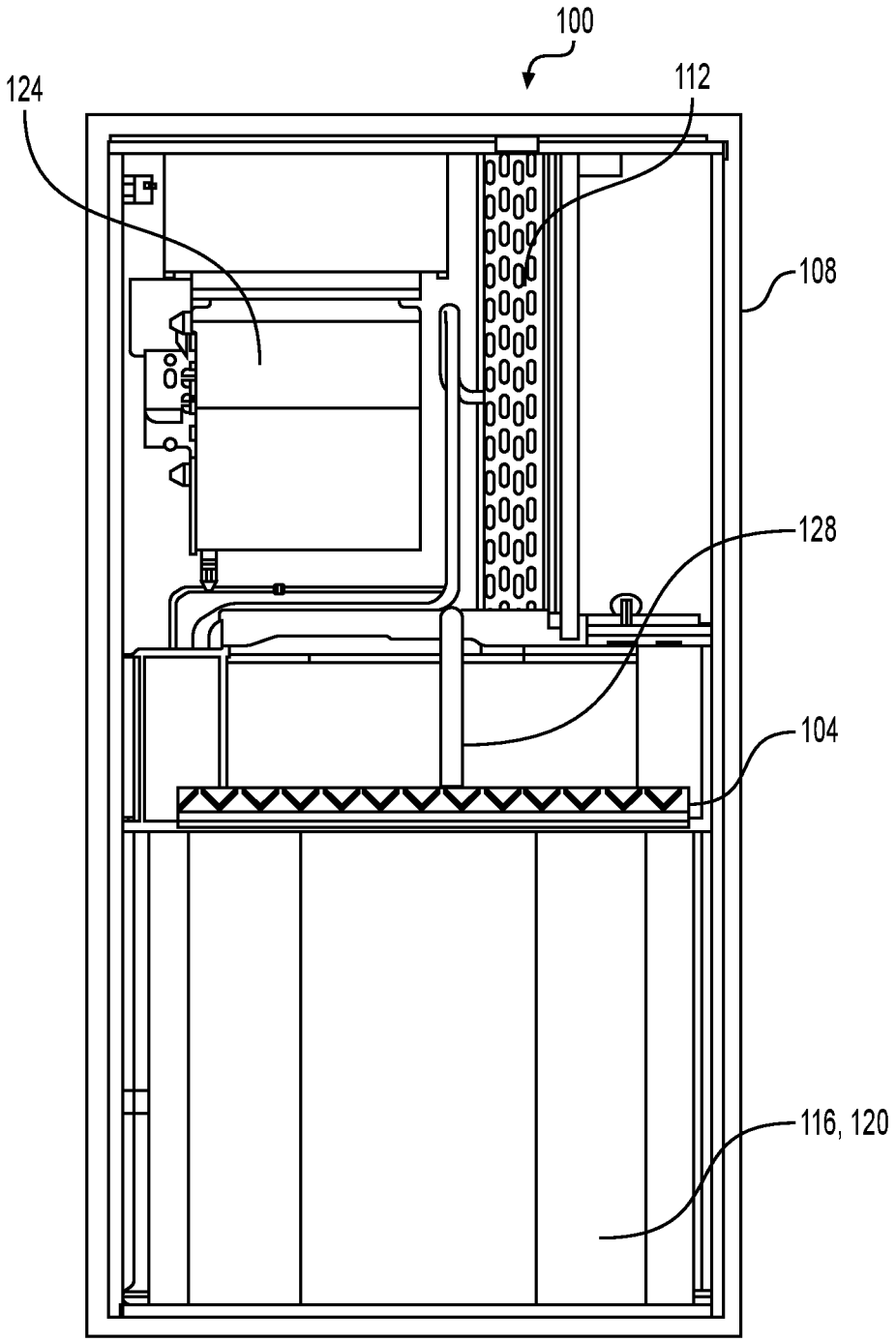
FIG. 1 is a schematic elevation view of an illustrative embodiment of a heating, ventilating, and cooling (HVAC) system in a cabinet with the front portion removed and showing a condensate discharge tray.

Referring now to the drawings and initially to FIG. 1, an illustrative embodiment of a heating, ventilating, and cooling (HVAC) system 100 is presented that includes an illustrative embodiment of a condensate discharge tray 104. The HVAC system 100 shown includes a cabinet 108 that holds closed refrigeration circuit including an evaporator 112 for cooling air and a condenser 116 with condenser fins 120. An air handler 124 is shown in the cabinet as well 108. On an interior of the condenser fins is a compressor (not explicitly shown; see 144 in FIG. 2). Operation of the system 100 creates condensate, e.g., chilled water, that is collected in a condensate collection pan (or evaporator drain pan) and delivered by condensate collection conduit 128 to the condensate discharge tray 104. Those skilled in the art will appreciate that pans, conduits, cascades, and other technique or device may be used to fluidly couple the condensate collection pan to the condensate discharge tray 104. The condensate discharge tray 104 collects and directs the condensate onto the condenser fins 120 so as to evaporate the condensate. This may eliminate all the condensate and further improve efficiency of the condenser 116. It should be noted that while a contained HVAC system 100 is shown, a distributed system may be used provided that condensate is delivered to the condensate discharge tray 104, which is coupled on a top portion of the condenser 116.

Figure 2:
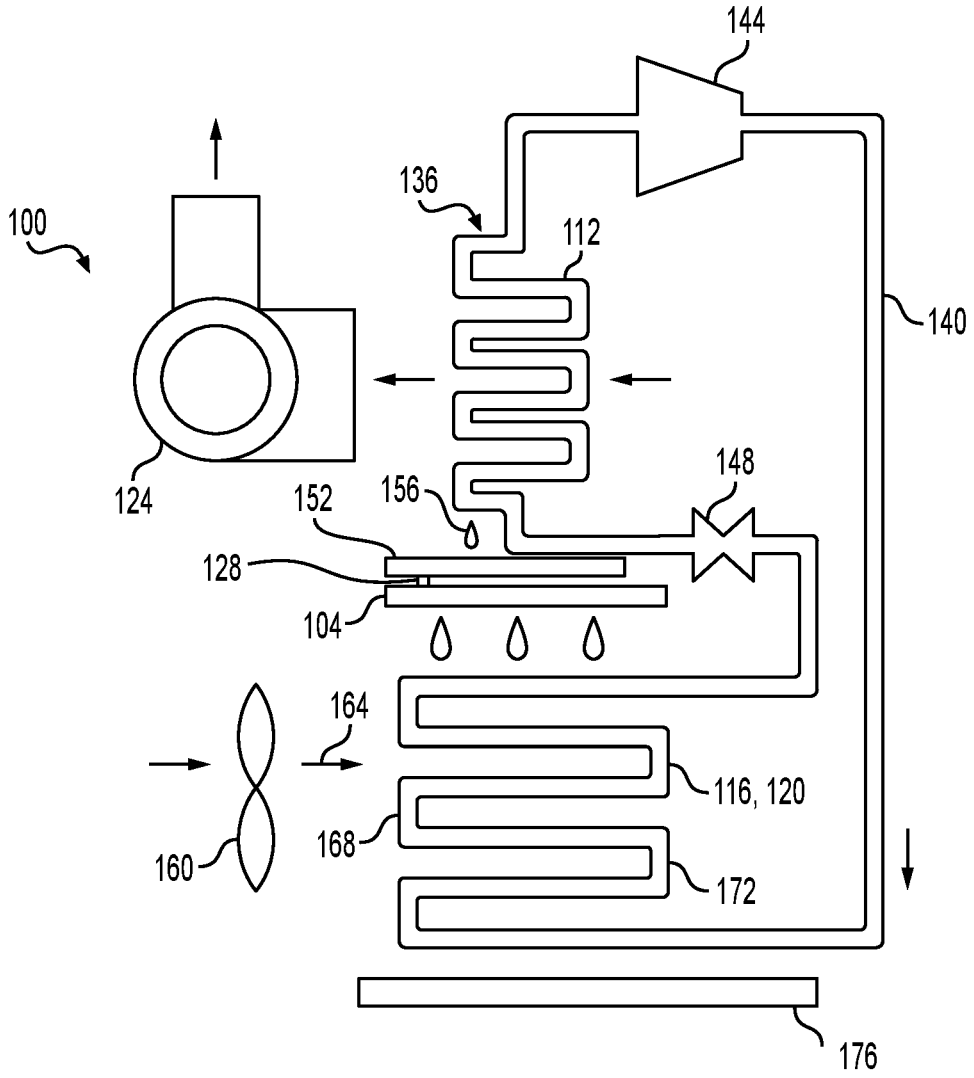
FIG. 2 is a schematic diagram of an illustrative embodiment of an HVAC system with a condensate discharge tray.

Referring now primarily to FIG. 2, an illustrative embodiment of an HVAC system 100 is presented that includes an illustrative embodiment of a condensate discharge tray 104. The system 100 includes a closed refrigeration circuit 136. The closed refrigeration circuit 136 includes a plurality of conduits 140 and a compressor 144 fluidly coupled to the plurality of conduits 140 for compressing a refrigerant. The closed refrigeration circuit 136 further includes a condenser 116 fluidly coupled to the plurality of conduits for receiving refrigerant from the compressor 144 and cooling the refrigerant, an evaporator 112, and an expansion valve 148, or metering device, fluidly coupled to the plurality of conduits 140 between the evaporator 112 and condenser 116. The evaporator 112 receives refrigerant from the expansion valve 148 and is fluidly coupled to the compressor 144 for delivering the refrigerant to the compressor 144.

The HVAC system 100 may further include condensate collection pan 152 proximate the evaporator 112 for receiving condensate 156, which forms on the evaporator 112. A condensate collection conduit 128 fluidly couples the condensate collection pan 152 to the condensate discharge tray 104. The air handler 124 may pull air across the evaporator 112. A fan or blower 160 may move air across the condenser 116 and condenser fins 120. The side of the condenser 116 receiving the air is an upstream or outboard side 168 and the other side is an inboard side 172. An additional collection pan 176 may be included in some embodiments that would capture any condensate that has not been evaporated and provided to a drain.

Figure 3:
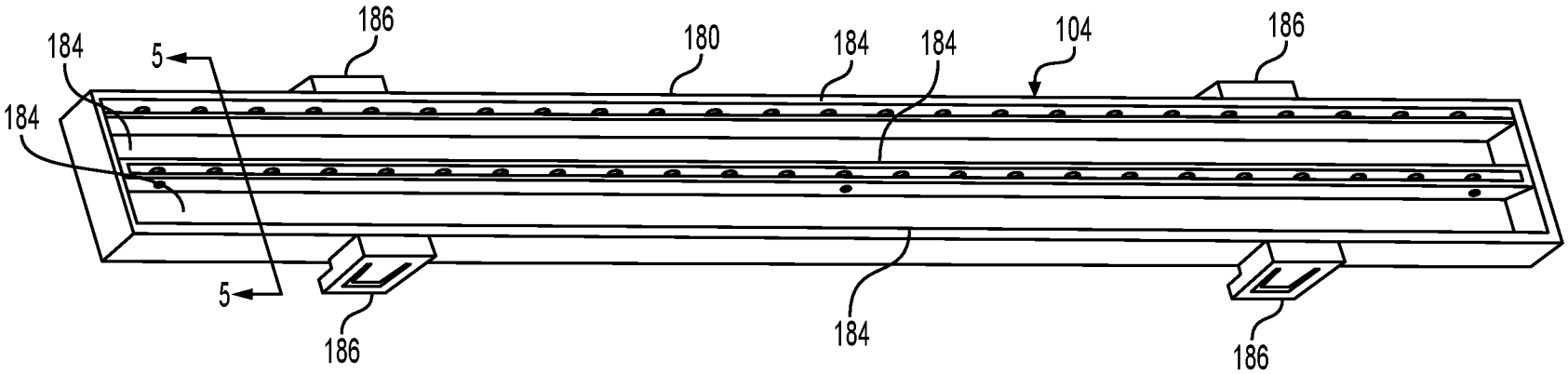
FIG. 3 is a schematic, perspective view of an illustrative embodiment of a condensate discharge tray.

Referring now to FIGS. 3-10, and initially to FIG. 3, an illustrative embodiment of the condensate discharge tray 104 is presented. The condensate discharge tray 104 may include a longitudinal body 180 formed with at least one longitudinal tank or a plurality of longitudinal tanks 184 for receiving condensate. The condensate discharge tray 104 also includes at least one longitudinal spillway or a plurality of longitudinal spillways formed adjacent to the plurality of longitudinal tanks 184 and aligned to deliver condensate in a dispersed fashion on the condenser 116, 120. The body 180 may be formed of any plastic or thermally stable material at a high temperature. A plurality of clamps or clips 186 for releasably coupling the condensate discharge tray 104 to an upper portion of the condenser 116.

Figure 4:
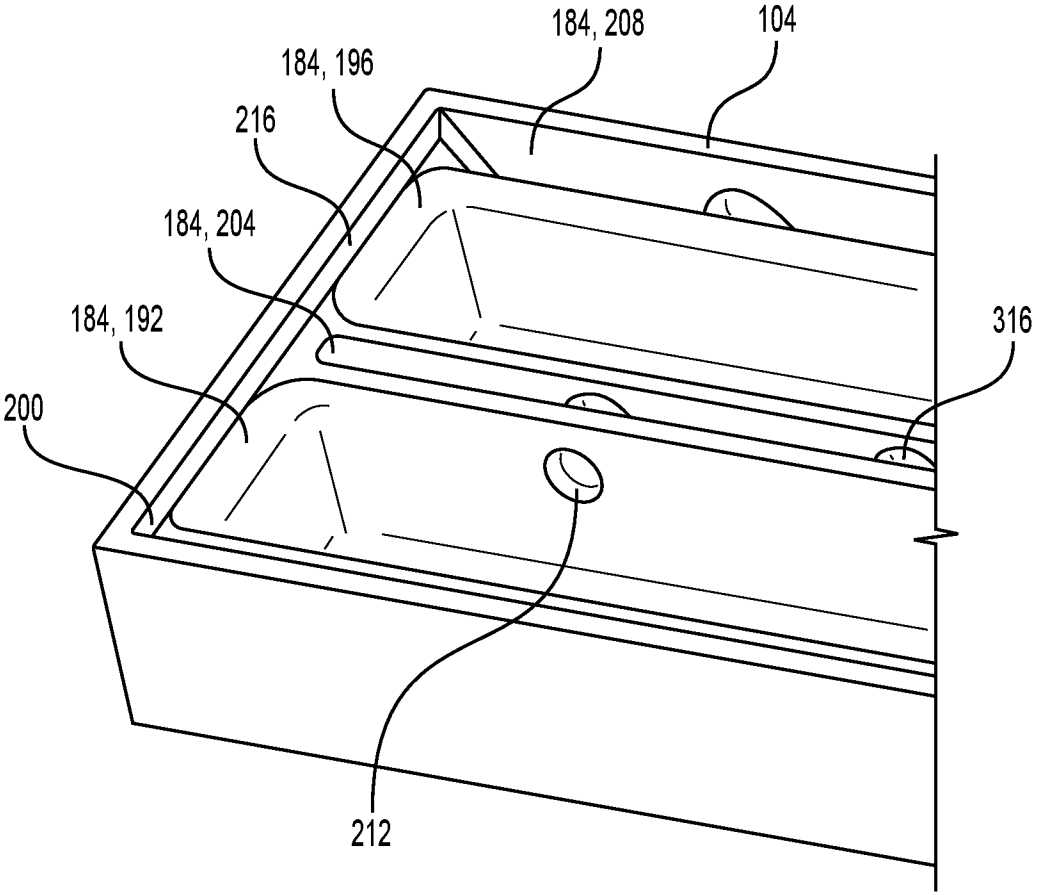
FIG. 4 is a schematic, perspective view of a portion of an illustrative embodiment of a condensate discharge tray.

Referring now primarily to FIG. 4, in one illustrative embodiment, the condensate discharge tray 104 includes a first longitudinal tank 192 and a second longitudinal tank 196. The condensate discharge tray 104 may include a first longitudinal spillway 200, a second longitudinal spillway 204, and a third longitudinal spillway 208. The condensate collection conduit 128 (FIGS. 1, 2) delivers condensate into the tanks 192, 196. A condensate leveling conduit 212 extends between the first tank 192 and the second tank 196 at a portion to facilitate keeping condensate at the same level when the tanks 192, 196 are getting full. The leveling conduit 212 may be at whatever level is desired between the tanks, e.g., very top, top, upper, middle, lower. Note that the outer wall has a higher portion, or edge stopper 216 to keep the condensate in an interior portion so that the condensate is directed to the spillways 184.

Figure 5:
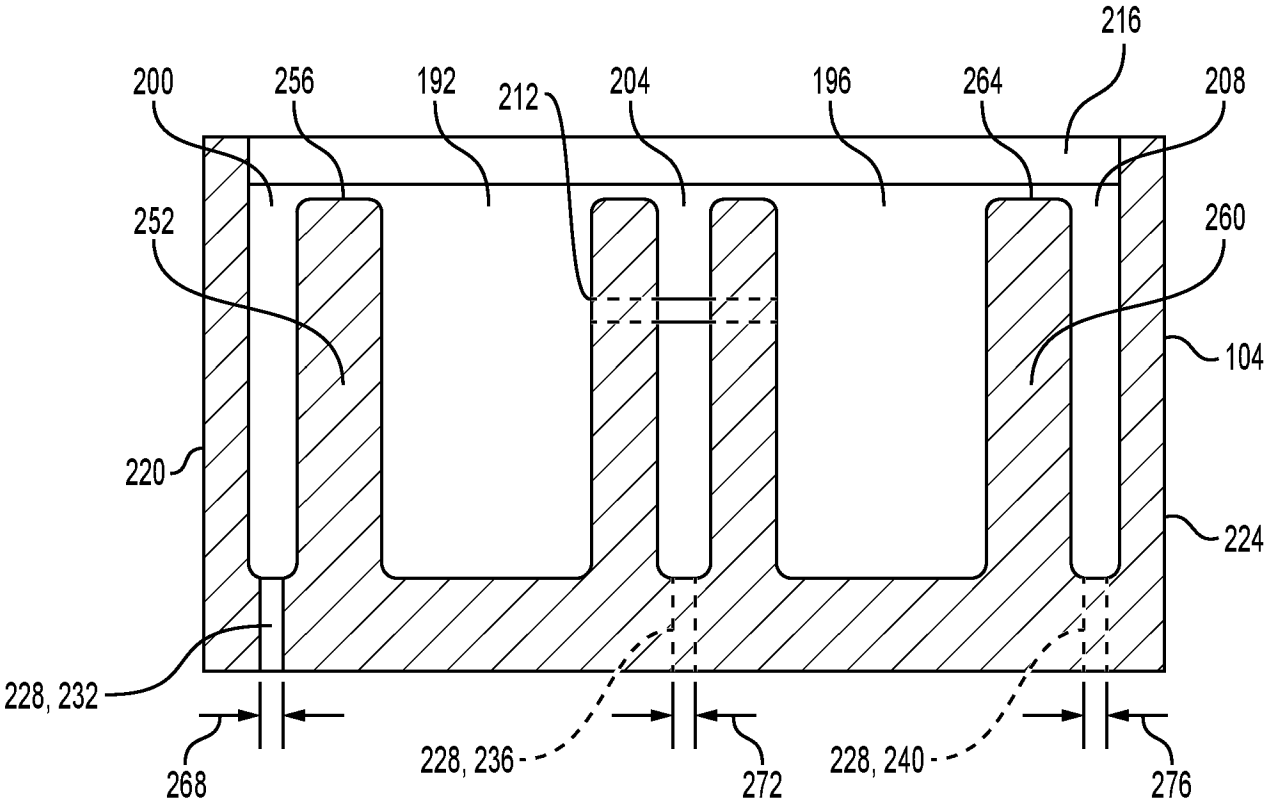
FIG. 5 is a schematic, lateral cross-sectional view of an illustrative embodiment of a condensate discharge tray.

Referring now primarily to FIG. 5, in one illustrative embodiment, in a lateral cross section of the condensate discharge tray 104 going from an outboard side 220 (or outer most of condenser when installed) to an inboard side 224 (or inner side of condenser when installed), the first longitudinal spillway 200 is adjacent to the first longitudinal tank 192. The first longitudinal tank 192 is adjacent to the second longitudinal spillway 204. The second longitudinal spillway 204 is adjacent to the second longitudinal tank 196, and the second longitudinal tank 196 is adjacent to the third longitudinal spillway 208.

Figure 6:
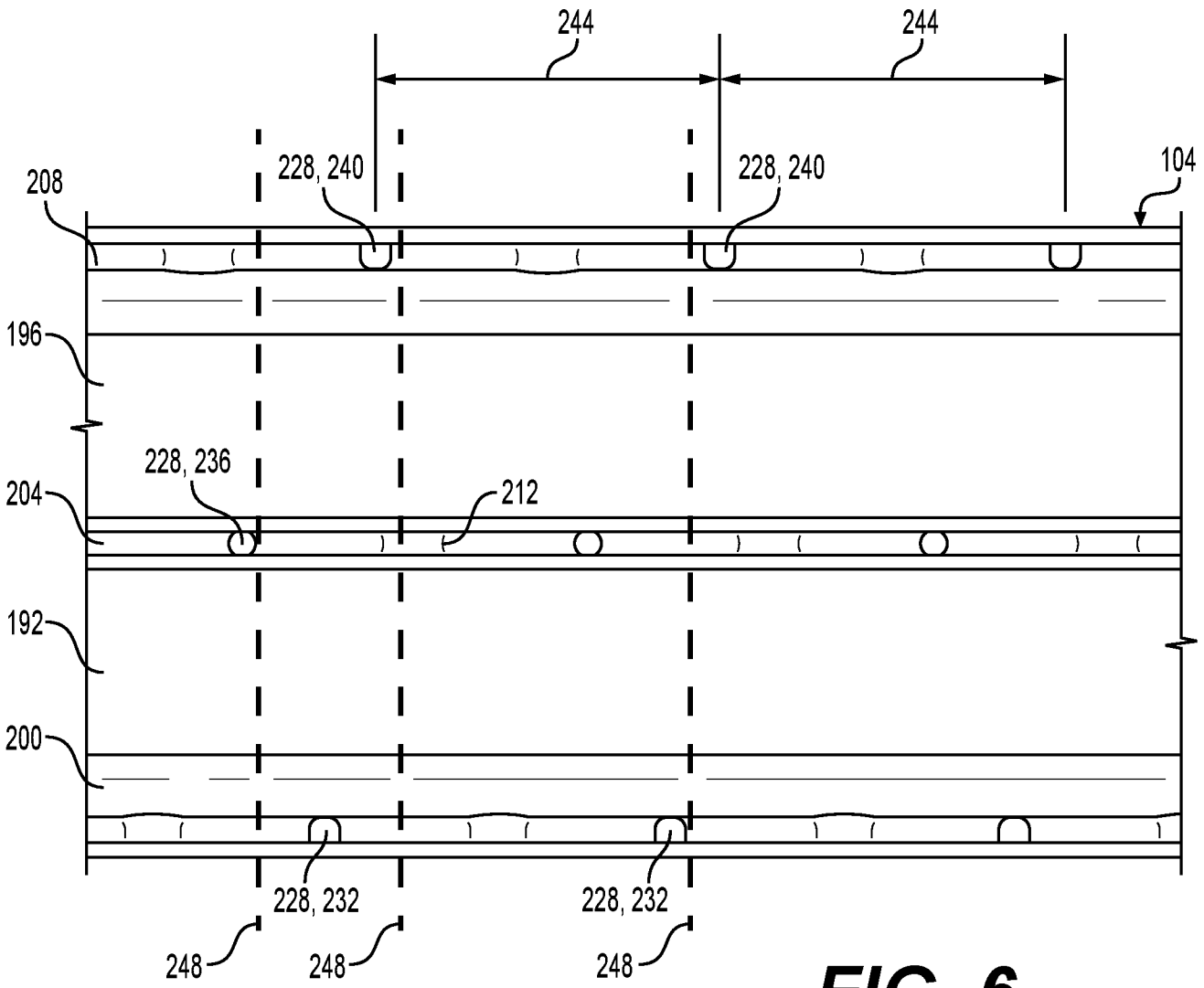
FIG. 6 is a schematic, plan view of a portion of an illustrative embodiment of a condensate discharge tray.

Referring primarily to FIGS. 5 and 6, the plurality of longitudinal spillways 184 are formed with a plurality of apertures 228. The first plurality of longitudinal spillways 200 are formed with a first plurality of apertures 232. The second plurality of longitudinal spillways 204 are formed with a second plurality of apertures 236. The third plurality of longitudinal spillways 208 are formed with a third plurality of apertures 240. The spillways 184 direct condensate from the condensate discharge tray 104 onto the condenser 116, or condenser fins 120. The apertures 228 are staggered or not aligned as shown clearly in FIG. 6. The interval spacing distance 244 may vary or may be uniform; in one illustrative embodiment the interval spacing distance is in the range of 0.4 to 0.75 inches and in one embodiment is 0.57 inches. Those skilled in the art will appreciate other dimensions may be used. In the embodiment of FIG. 6, the apertures 228 are longitudinally displaced from one another as suggested by the lateral reference lines 248.

As shown clearly in FIG. 5, a first common wall 252 between the first longitudinal tank 192 and the first longitudinal spillway 200 has a rounded edge or end 256. Likewise, second common wall 260 between the second longitudinal tank 196 and the third spillway 208 has a rounded edge or end 264.

The diameters or area of the apertures 228 may vary by spillway and position. In one illustrative embodiment, the first plurality of apertures 232 have a diameter D1 268. The first spillway 200 aligns with an outboard portion of the condenser 116. The second plurality of apertures 236 have a diameter D2 272. The third plurality of apertures 240 have a diameter D3 276. In one embodiment, D2>D1>D3. D3 is on the inner side of the condenser when installed. In one illustrative embodiment, the diameter ratios are D2:D1:D3=1:0.8:0.6. In one illustrative embodiment, the longitudinal length of the condensate discharge tray is 15.5 inches. In instance, 0.4' max for larger side and 10.5" max×0.4" max for shorter tray. Those skilled in the art will appreciate that other dimensions may be used.

Figure 7:
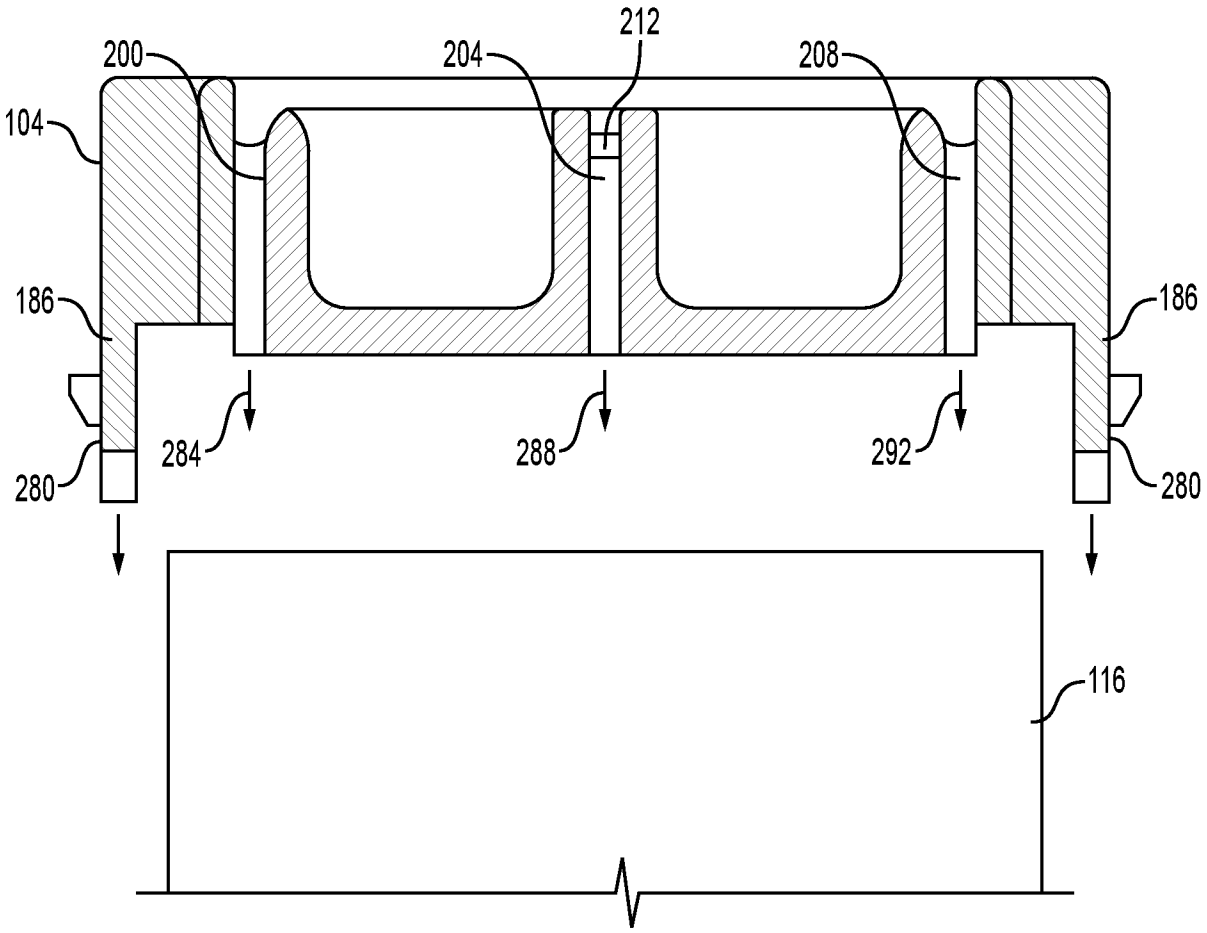
FIG. 7 is a schematic, lateral cross-sectional view of an illustrative embodiment of a condensate discharge tray.

Referring now primarily to FIG. 7, an illustrative embodiment of a condensate discharge tray 104 is shown being releasably coupled to a condenser 116 (or a panel right above the condenser coil) using clamps or clips 186. The coupling is such that apertures align with the fins of the condenser 116. The clamps 186 may include plastic arms that form an interference fit with the condenser 116. In other embodiments, the clamps 186 may be fasteners, e.g., screws, bolts, brackets, etc. In this view, one may see that the first longitudinal spillway 200 releases condensate stream 284. The second longitudinal spillway 204 releases condensate stream 288. The third longitudinal spillway 208 releases condensate stream 292.

Figure 8:
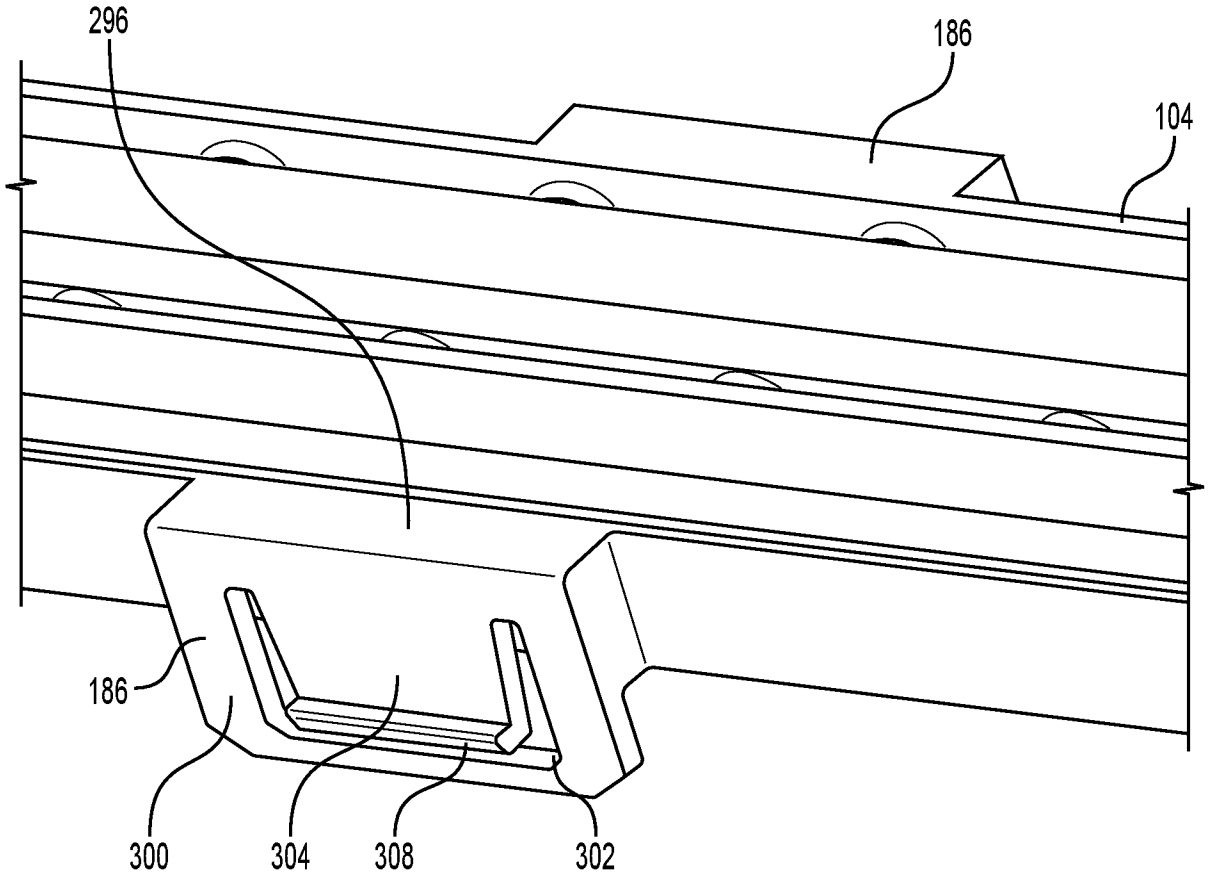
FIG. 8 is a schematic, perspective view of a portion of an illustrative embodiment of a condensate discharge tray.
Figure 9:
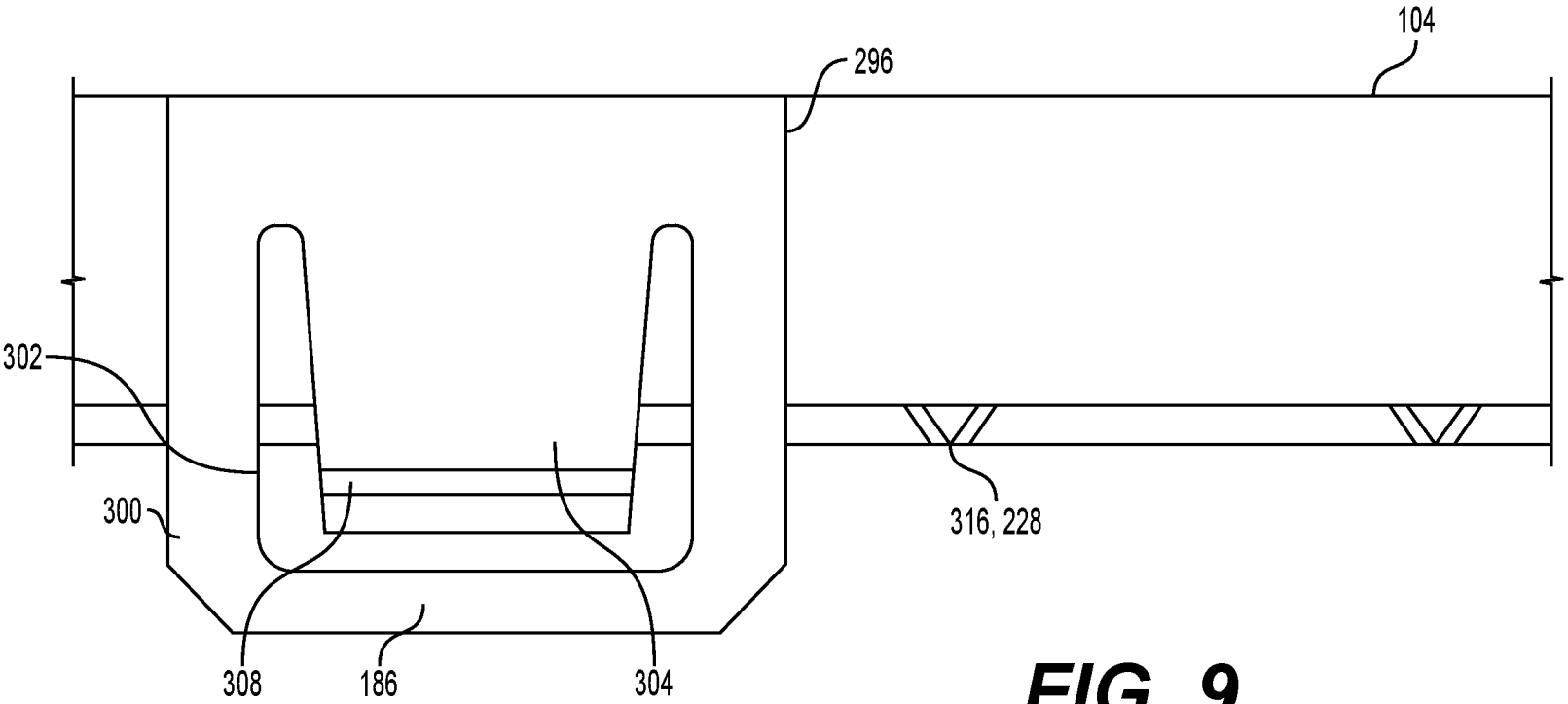
FIG. 9 is a schematic, elevation view of a portion of an illustrative embodiment of a condensate discharge tray.

Referring now primarily to FIGS. 8-9, an illustrative embodiment of condensate discharge tray 104 is presented. In this view, the clamps or clips 186 are shown according to one embodiment. The clamp 186 includes a base 296 coupled to an exterior wall of the condensate discharge tray 104. The base 296 transitions to a frame 300 with a cutout 302 and a tongue 304 with ledge 308. The tongue 304 deflects or deforms to latch onto a portion of the condenser 116.

Figure 10:
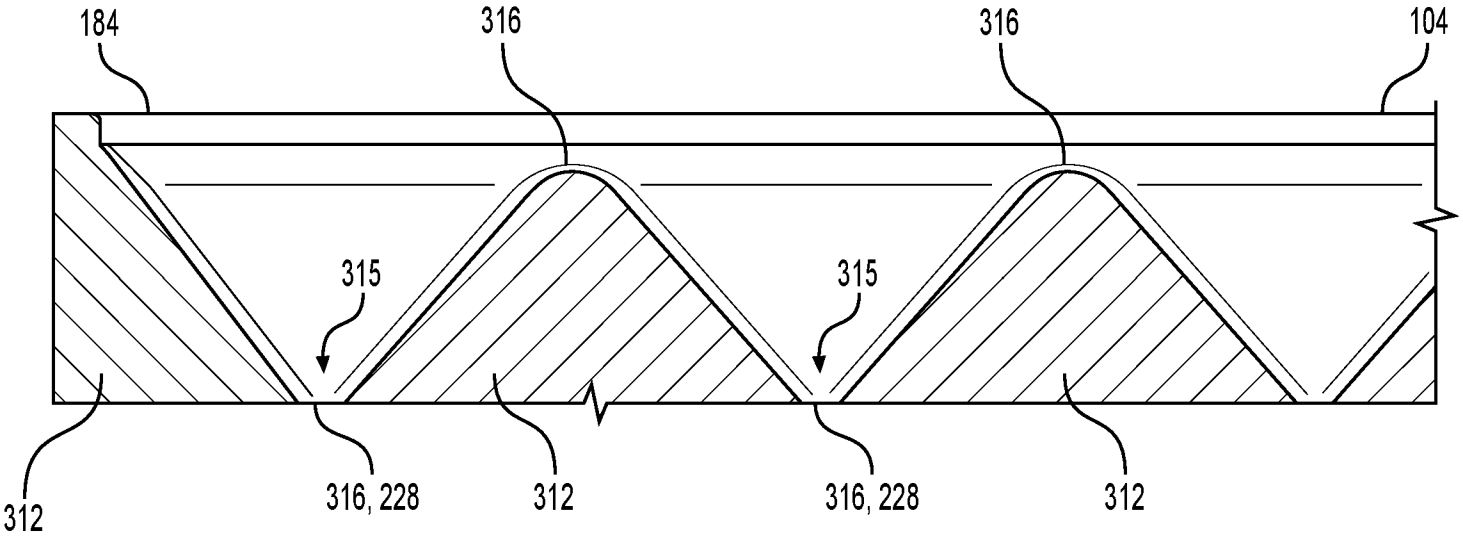
FIG. 10 is a schematic, longitudinal, elevation view from within an interior of a portion of an illustrative embodiment of a condensate discharge tray.

Referring now primarily to FIG. 10, a portion of an illustrative embodiment of a condensate discharge tray 104 is shown. In this view, the perspective is from within the tank at the longitudinal wall of a longitudinal spillway. The spillway 184 is formed with a plurality of inverted V-shaped ribs 312. The apex 316 can be seen in some of the other figures. Between the bottoms of the ribs 312, there is a gap 315 where apertures 228 may be formed.

In some embodiments, an interior of the plurality of longitudinal tanks may be formed features or texture for increasing surface area and surface tension with liquids therein. For example, the condensate tanks may have parallel lines or texture formed thereon to increase the surface area of the compartment surfaces. This in turn may increase the water surface tension which helps hold back the condensate until a certain load of condensate has been added.

In one illustrative embodiment that uses an HVAC system with a two-row condenser coil, the condensate distribution tray may have two coupled compartments, or tanks, to receive condensate. Upon reaching a specified level of condensate, the condensate overflows through spillways on two sides and at the center of the condenser. The tray is positioned over the condenser fins.

The spillways on the condensate distribution tray may be inverted V-shaped ribs with a gap between two ribs in the lower end. The spillways are connected on the top to enable the overflow condensate to streamline over the condenser fins. A laminar flow may be particularly useful. The center separation wall may have apertures to assist in making the condensate level in the two tanks the same.

In some embodiments, the condensate distribution tray may have an edge stopper along the long edges and ribs along the shorter walls. The stoppers along the long edges direct condensate to flow only in the desired ways. The ribs help streamline the water flowing. The gap between two ribs in the bottom may also help in timing the water flow into the condenser fins.

In some embodiments, apertures (e.g., 228) may be formed in the spillways, or other drains to the condenser provided. The one or more apertures are formed at the end of the spillways. The apertures allow the condensate to reach the condenser coil and associated fins. The size and distribution of the apertures may be used to control the flow of condensate as desired. In one embodiment, the aperture in the center spillway is larger than the other apertures to move more volume of condensate to that location. The outermost spillways may have the second largest aperture size and the inner most aperture the least. This arrangement is to facilitate evaporative capacity of the different positions.

The center spillway may be aligned to direct the most condensate between the two coils of the condenser because more heat is available to evaporate the condensate. The second largest apertures are associated with a location that has low pressure from the fan (e.g., 160) and air flowing from outside to inside and can handle a middle range of condensate. The inner most spillway has the smallest apertures in some embodiments to direct the least condensate there. This is because condensate at that location may be pushed out due to the air flow away from the condenser coil.

The apertures in the condensate distribution tray in the various sections are not in the same line in some embodiments. The apertures may be offset with each other-staggered-so that all the condensate does not flow in the same region. The offset also helps in scattering the spill of condensate.

According to one illustrative embodiment, an HVAC system develops condensate that is collected in a condensate distribution tray from a drain tube. The condensate distribution tray is positioned over the condenser fins/condenser. Condensate is dripped on the condenser coils at regular intervals or at regular pace so that the droplets evaporate completely before the next drop arrives. As condensate is collected in a tank, the overflow may be continuous and even across the length of the tank. While two coils are referenced here, it should be understood that other coil counts may be used; e.g., one row coil has two spillways and the two-row coil design has three spillways, etc.

According to some illustrative embodiments, a number of beneficial results may be realized by using a condensate distribution tray, such as those shown and described above. For example, an HVAC unit may remain fully dry by evaporating all the condensate. The lower temperature condensate delivered onto the condenser may improve efficiency of the condenser since the condensate functions as an additional cooling system. In some embodiments, an HVAC unit may be installed without requiring plumbing connections. Other possible benefits may be realized.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A heating, ventilating, and cooling (HVAC) system comprising:

a closed refrigeration circuit comprising:

a plurality of conduits, a compressor fluidly coupled to the plurality of conduits for compressing a refrigerant, a condenser fluidly coupled to the plurality of conduits for receiving refrigerant from the compressor and cooling the refrigerant, an evaporator, an expansion valve fluidly coupled to the plurality of conduits between the evaporator and condenser, and wherein the evaporator receives refrigerant from the expansion valve and wherein the evaporator is fluidly coupled to the compressor for delivering the refrigerant to the compressor;

a condensate collection pan proximate the evaporator for receiving condensate which forms on the evaporator;

a condensate discharge tray coupled to a top portion of the condenser;

a condensation collection conduit that is fluidly coupled to the condensate collection pan and the condensate discharge tray; and wherein the condensate discharge tray comprises:

a longitudinal body formed with a plurality of longitudinal tanks for receiving condensate, a plurality of longitudinal spillways formed laterally adjacent to the plurality of longitudinal tanks and aligned to deliver condensate in a dispersed fashion on the condenser, wherein at least one of the plurality of longitudinal tanks and at least one of a plurality of longitudinal spillways share a common wall.

2. The HVAC system of claim 1, wherein:

the plurality of longitudinal tanks comprises a first tank and a second tank;

the plurality of longitudinal spillways comprises a first longitudinal spillway, a second longitudinal spillway, and a third longitudinal spillway, a cross section of the condensate discharge tray includes the first longitudinal spillway adjacent to the first longitudinal tank, the first longitudinal tank adjacent to the second longitudinal spillway, the second longitudinal spillway adjacent to the second longitudinal tank, and the second longitudinal tank adjacent to the third longitudinal spillway;

a condensate leveling conduit extending from the first longitudinal tank to the second longitudinal tank;

wherein the first spillway is formed with a plurality of spaced apertures for directing condensate onto the condenser below;

wherein the second longitudinal spillway is formed with a plurality of spaced apertures for directing condensate onto the condenser below; and wherein the third longitudinal spillway is formed with a plurality of spaced apertures for directing condensate onto the condenser below.

3. The HVAC system of claim 2, wherein the first longitudinal spillway, second longitudinal spillway, and third longitudinal spillway each comprises a plurality of inverted V-shaped ribs with a gap having an aperture between at least some of the V-shaped ribs.

4. The HVAC system of claim 2, wherein the condensate discharge tray comprises a plurality of clamps for releasably coupling the condensate discharge tray onto a top portion of the condenser.

5. The HVAC system of claim 2, wherein the condensate discharge tray comprises a plurality of clamps for releasably coupling the condensate discharge tray onto a top portion of the condenser and wherein the plurality of clamps comprises a plurality of interference-fit clamps.

6. The HVAC system of claim 1, wherein all of the condensate is directed by the condensate discharge tray onto the condenser and evaporated.

7. The HVAC system of claim 2, wherein:

a first common wall between the first tank and the first longitudinal spillway has a rounded edge; and a second common wall between the second longitudinal tank the third longitudinal spillway has a rounded edge.

8. The HVAC system of claim 2, wherein the plurality of apertures of the first longitudinal spillway, the plurality of apertures of the second longitudinal spillway, and the plurality of apertures of the third longitudinal spillway are longitudinally displaced from one another.

9. The HVAC system of claim 2, wherein each of the plurality of apertures of the first longitudinal spillway have a first size, D1, each of the plurality of apertures of the second longitudinal spillway have a second size, D2, and each of the plurality of apertures of the third longitudinal spillway have a third size, D3, and wherein D2>D1>D3, and wherein the apertures of the first longitudinal spillway align with an outer edge of the condenser when in an installed position.

10. The HVAC system of claim 1, wherein an interior of the plurality of longitudinal tanks comprises formed features for increasing surface area and surface tension with liquids therein.

11. The HVAC system of claim 2, wherein:

the first longitudinal spillway, second longitudinal spillway, and third longitudinal spillway each comprises a plurality of inverted V-shaped ribs with a gap having an aperture between at least some of the V-shaped ribs;

the condensate discharge tray comprises a plurality of snap-fit clamps for releasably coupling the condensate discharge tray onto a top portion of the condenser;

all of the condensate is directed by the condensate discharge tray onto the condenser and evaporated;

a first common wall between the first longitudinal tank and the first spillway has a rounded edge;

a second common wall between the second longitudinal tank the third longitudinal spillway has a rounded edge;

the plurality of apertures of the first longitudinal spillway, the plurality of apertures of the second longitudinal spillway, and the plurality of apertures of the third longitudinal spillway are longitudinally displaced from one another; and wherein each of the plurality of apertures of the first longitudinal spillway have a first size, D1, each of the plurality of apertures of the second longitudinal spillway have a second size, D2, and each of the plurality of apertures of the third longitudinal spillway have a third size, D3, and wherein D2>D1>D3, and wherein the apertures of the first longitudinal spillway align with an outer edge of the condenser when in an installed position.

12. A heating, ventilating, and cooling (HVAC) system comprising:

a closed refrigeration circuit comprising a condenser and an evaporator;

a condensate collection pan proximate the evaporator for receiving condensate which forms on the evaporator;

a condensate discharge tray fluidly coupled to the condensate collection pan and coupled to a top portion of the condenser; and wherein the condensate discharge tray comprises:

at least one longitudinal tank for receiving condensate from the condensate collection pan, at least one longitudinal spillway fluidly coupled to the at least one longitudinal tank for receiving condensate therefrom, wherein the at least one longitudinal tank and the at least one longitudinal spillway share a common wall, and a plurality of apertures formed in the at least one longitudinal spillway for allowing condensate to discharge from the condensate discharge tray onto the condenser.

13. The HVAC system of claim 12, wherein:

the condensate discharge tray comprises a body;

the at least one longitudinal tank comprises a first longitudinal tank and a second longitudinal tank formed in the body;

the at least the longitudinal spillway comprises a first longitudinal spillway, a second longitudinal spillway, and a third longitudinal spillway formed in the body;

a first plurality of apertures formed in the first longitudinal spillway, each having a first diameter, D1;

a second plurality of apertures formed in the first longitudinal spillway, each having a first diameter, D2;

a third plurality of apertures formed in the first longitudinal spillway, each having a first diameter, D3;

wherein in a lateral cross section of the condensate discharge tray going from the outboard to inboard sides, the first longitudinal spillway is adjacent to the first tank which is adjacent to the second longitudinal spillway, the second longitudinal spillway is adjacent to the second tank and the second tank is adjacent to the third longitudinal spillway; and wherein D2 is bigger than D1 and D1 is bigger than D3.

14. The HVAC system of claim 12, wherein:

the at least one longitudinal spillway comprises at least two longitudinal spillways;

the at least one longitudinal tank comprises at least two longitudinal tanks;

wherein the plurality of apertures in the at least two longitudinal spillways are offset longitudinally;

at least one condensate leveling conduit extending between the at least two longitudinal tanks for distributing condensate between the at least two longitudinal tanks;

the at least two longitudinal spillways are formed with inverted V-shaped ribs; and wherein the plurality of apertures formed in the plurality of longitudinal spillways is sized and configured to release most of the condensate in a middle portion.

* * * * *